US005608935A

United States Patent [19]

Warfield

[11] Patent Number: 5,608,935

[45] Date of Patent: Mar. 11, 1997

[54] GROUND SUPPORTED HEAD REST

[76] Inventor: Christopher A. Warfield, 17 Jonathans Ct., Hunt Valley, Md. 21030

[21] Appl. No.: 450,668

[22] Filed: May 30, 1995

[51] Int. Cl.[6] ..... A47C 20/00

[52] U.S. Cl. ..... 5/639; 5/643

[58] Field of Search ..... 5/636, 638, 639, 5/643, 663, 909, 922, 461

[56] References Cited

U.S. PATENT DOCUMENTS

| | | | |
|---|---|---|---|
| 2,551,727 | 5/1951 | Costello | 5/643 |
| 4,535,878 | 8/1985 | Grahl | 5/638 |
| 4,779,297 | 10/1988 | Sturges | 5/638 |
| 5,343,582 | 9/1994 | Baylor | 5/636 |
| 5,426,798 | 6/1995 | Guarino | 5/461 |

FOREIGN PATENT DOCUMENTS

| | | | |
|---|---|---|---|
| 1061219 | 8/1979 | Canada | 5/638 |
| 648099 | 2/1985 | Switzerland | 5/663 |

*Primary Examiner*—Lloyd A. Gall
*Assistant Examiner*—Robert G. Santos

[57] ABSTRACT

A head rest for supporting a human head relative to a ground surface. The inventive device includes a base frame positionable upon a ground surface. An upper frame is supported at an angle relative to the base frame by a plurality of stanchions extending therebetween. A perimeter pad extends about the upper frame for engaging a human head. The upper frame is substantially oval in shape to accommodate a human head in both prone and supine positions.

5 Claims, 4 Drawing Sheets

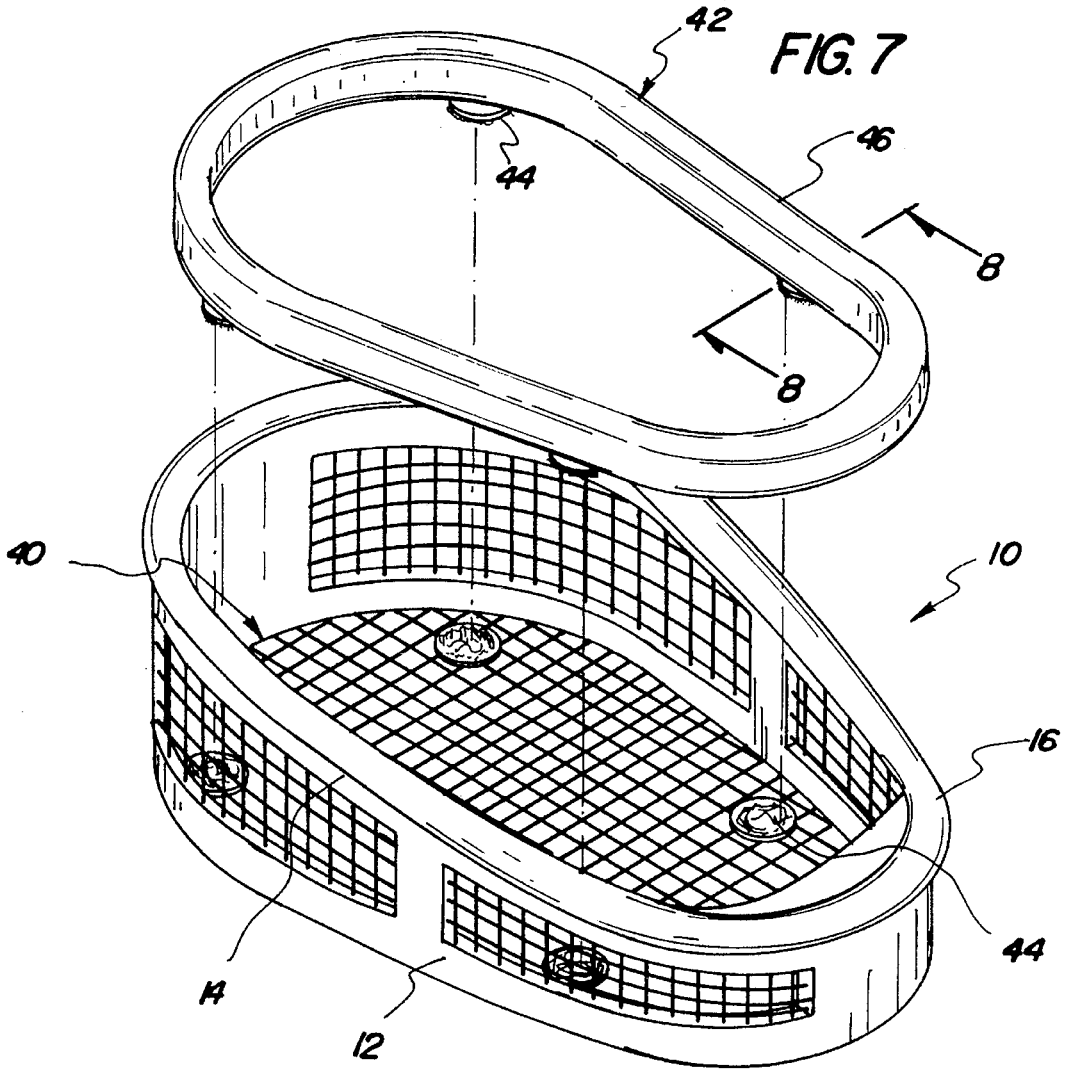
FIG. 8
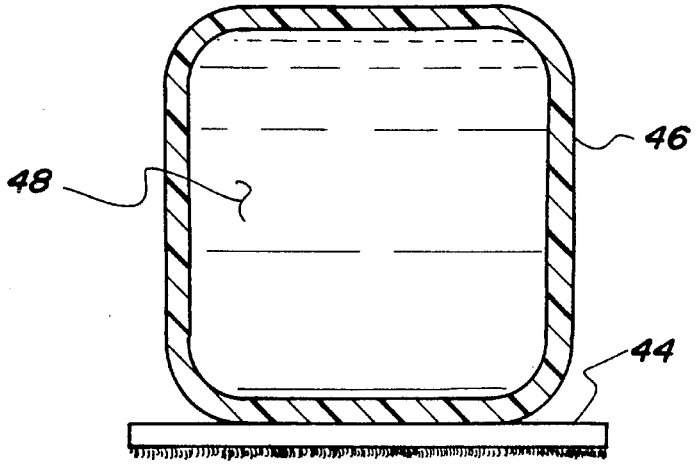

GROUND SUPPORTED HEAD REST

BACKGROUND OF THE INVENTION

1. Field of the Invention

The present invention relates to body supporting devices and more particularly pertains to a ground supported head rest for supporting a human head relative to a ground surface.

2. Description of the Prior Art

The use of body supporting devices is known in the prior art. More specifically, body supporting devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art body supporting devices include U.S. Pat. No. 5,044,026; U.S. Pat. No. 5,095,569; U.S. Pat. No. 4,932,089; U.S. Pat. No. 4,815,154; U.S. Des. Pat. No. 298,992; and U.S. Des. Pat. No. 309,542.

While these devices fulfill their respective, particular objectives and requirements, the aforementioned patents do not disclose a ground supported head rest for supporting a human head relative to a ground surface which includes a base frame positionable upon a ground surface, an upper frame supported at an angle relative to the base frame, and a perimeter pad extending about the upper frame for engaging a human head, wherein the upper frame is substantially oval in shape to accommodate a human head in both prone and supine positions.

In these respects, the ground supported head rest according to the present invention substantially departs from the conventional concepts and designs of the prior art, and in so doing provides an apparatus primarily developed for the purpose of supporting a human head relative to a ground surface.

SUMMARY OF THE INVENTION

In view of the foregoing disadvantages inherent in the known types of body supporting devices now present in the prior art, the present invention provides a new ground supported head rest construction wherein the same can be utilized for supporting a human head relative to a ground surface. As such, the general purpose of the present invention, which will be described subsequently in greater detail, is to provide a new ground supported head rest apparatus and method which has many of the advantages of the body supporting devices mentioned heretofore and many novel features that result in a ground supported head rest which is not anticipated, rendered obvious, suggested, or even implied by any of the prior art body supporting devices, either alone or in any combination thereof.

To attain this, the present invention generally comprises a head rest for supporting a human head relative to a ground surface. The inventive device includes a base frame positionable upon a ground surface. An upper frame is supported at an angle relative to the base frame by a plurality of stanchions extending therebetween. A perimeter pad extends about the upper frame for engaging a human head. The upper frame is substantially oval in shape to accommodate a human head in both prone and supine positions.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new ground supported head rest apparatus and method which has many of the advantages of the body supporting devices mentioned heretofore and many novel features that result in a ground supported head rest which is not anticipated, rendered obvious, suggested, or even implied by any of the prior art body supporting devices, either alone or in any combination thereof.

It is another object of the present invention to provide a new ground supported head rest which may be easily and efficiently manufactured and marketed.

It is a further object of the present invention to provide a new ground supported head rest which is of a durable and reliable construction.

An even further object of the present invention is to provide a new ground supported head rest which is susceptible of a low cost of manufacture with regard to both materials and labor, and which accordingly is then susceptible of low prices of sale to the consuming public, thereby making such ground supported head rests economically available to the buying public.

Still yet another object of the present invention is to provide a new ground supported head rest which provides in the apparatuses and methods of the prior art some of the advantages thereof, while simultaneously overcoming some of the disadvantages normally associated therewith.

Still another object of the present invention is to provide a new ground supported head rest for supporting a human head relative to a ground surface.

Yet another object of the present invention is to provide a new ground supported head rest which includes a base frame positionable upon a ground surface, an upper frame supported at an angle relative to the base frame, and a perimeter pad extending about the upper frame for engaging a human head, wherein the upper frame is substantially oval in shape to accommodate a human head in both prone and supine positions.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is an exploded isometric illustration of the invention including an interior pad.

FIG. 8 is a cross-sectional view taken along line 8—8 of FIG. 7.

DESCRIPTION OF THE PREFERRED EMBODIMENT

Figure 1:
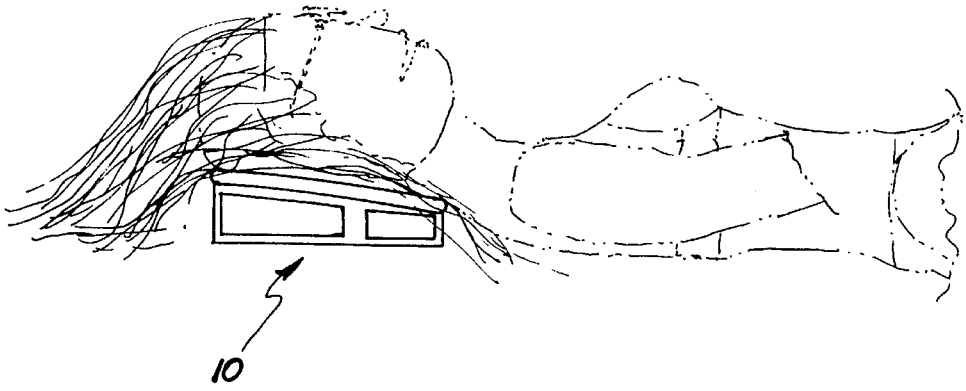
FIG. 1 is an elevation view of a ground supported head rest according to the present invention in use.

With reference now to the drawings, and in particular to FIGS. 1–8 thereof, a new ground supported head rest embodying the principles and concepts of the present invention and generally designated by the reference numeral 10 will be described.

More specifically, it will be noted that the ground supported head rest 10 comprises a base frame 12 positionable upon a ground surface, as shown during use of the device 10 in FIG. 1 of the drawings. An upper frame 14 is mounted relative to the base frame 12 so as to extend at an oblique angle relative to a plane containing the base frame 12. A perimeter pad 16 extends about the upper frame 14 for engaging a human head as shown in FIG. 1 of the drawings. By this structure, a human head can be supported relative to a ground surface in a comfortable position for tanning or the like in both prone and supine positions.

Figure 2:
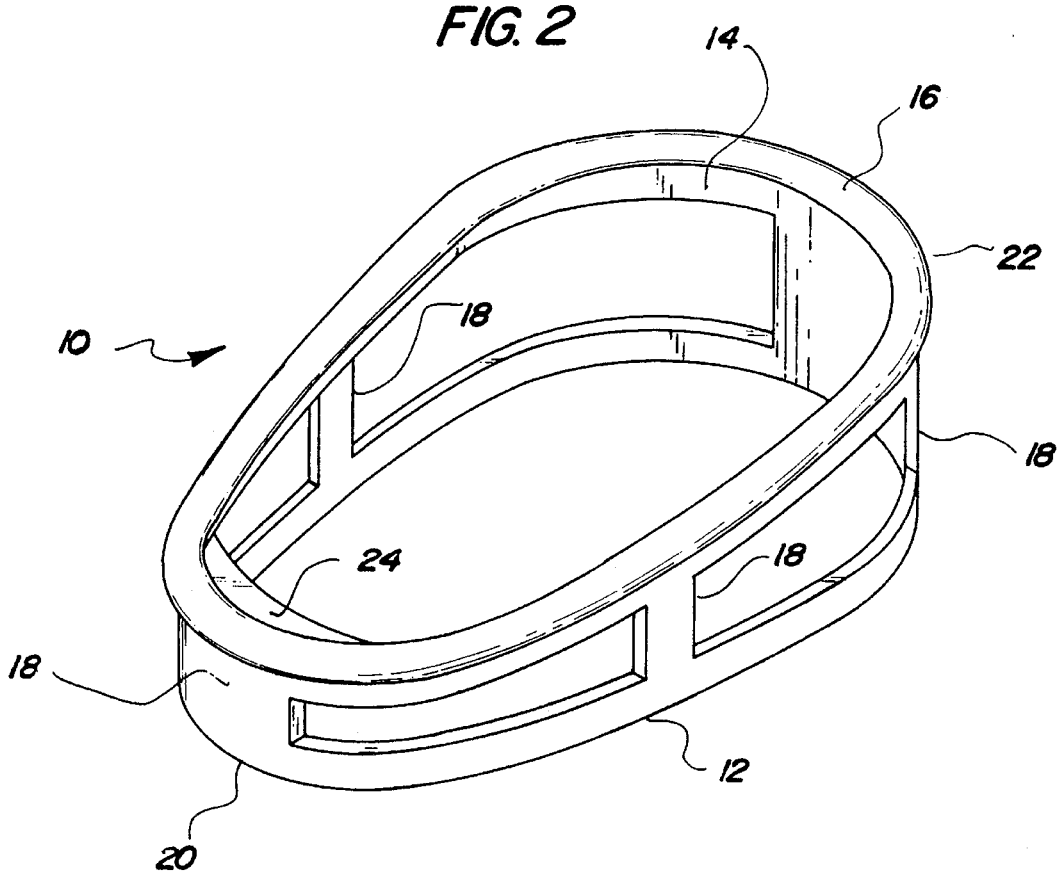
FIG. 2 is an isometric illustration of the present invention, per se.
Figure 3:
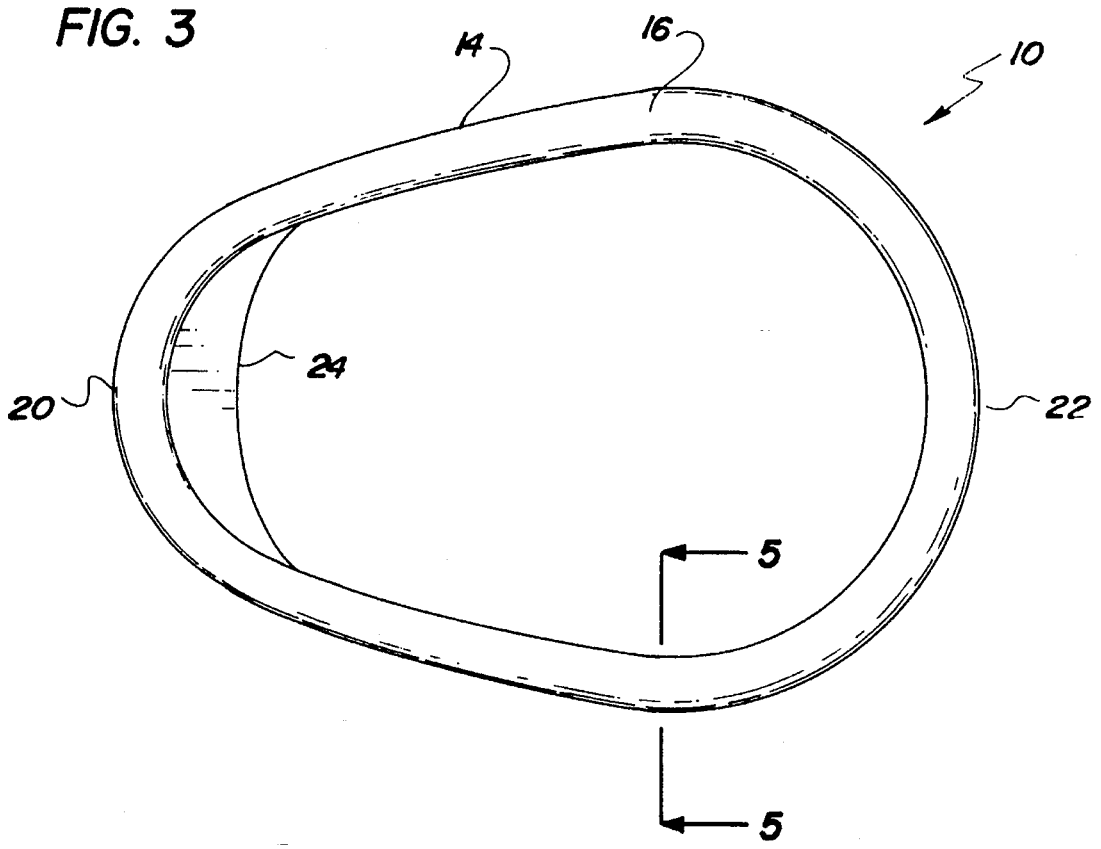
FIG. 3 is a top plan view of the invention.

Referring now to FIGS. 2 and 3 wherein the present invention 10 is illustrated in detail, it can be shown that the upper frame 14 is supported relative to the base frame 12 by a plurality of stanchions 18 extending therebetween. The present invention 10 includes a first end 20 spaced from a second end 22, with the upper frame 14 being spaced a first distance apart from the base frame 12 at the first end, and a second distance apart from the base frame at the second end. Preferably, the second distance is substantially greater than the first distance so as to define the angular orientation of the upper frame 14 relative to the base frame 12 as shown in the drawings. Further, and as shown in FIG. 3, the upper frame 14 is of a first transverse width at the first end 20 thereof and continues to enlarge to a second transverse width proximal to the second end 22 of the device 10, wherein the second width is substantially greater than the first width so as to define a substantially ovoid shape of the upper frame as illustrated in the drawings. A chin rest 24 preferably projects from an interior portion of the upper frame 14 proximal to the first end 20 and operates to receive and support a chin of an individual lying in a prone or face down position. By this structure, an individual's head can be easily supported relative to a ground surface in either the supine position illustrated in FIG. 1 of the drawings, or in a prone position wherein the person is lying face down. The spacing between the stanchions 18 supporting the upper frame 14 relative to the base frame 12 permits an individual to easily breathe when lying in a prone or face down position during use of the device 10.

Figure 5:
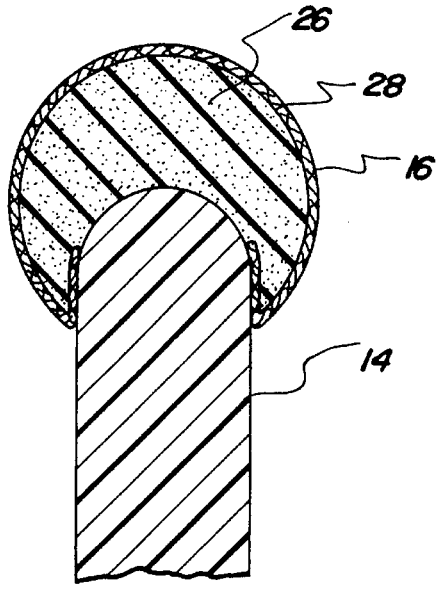
FIG. 5 is a cross-sectional view taken along line 5—5 of FIG. 3.

As shown in FIG. 5, the perimeter pad 16 is preferably comprised of an elongated cylindrical foam core 26 having a slot directed thereinto which receives a portion of the upper frame 14. An outer covering 28 encapsulates the foam core 26 and may be of a waterproof construction so as to preclude a fluid saturation of the foam core 26.

Figure 4:
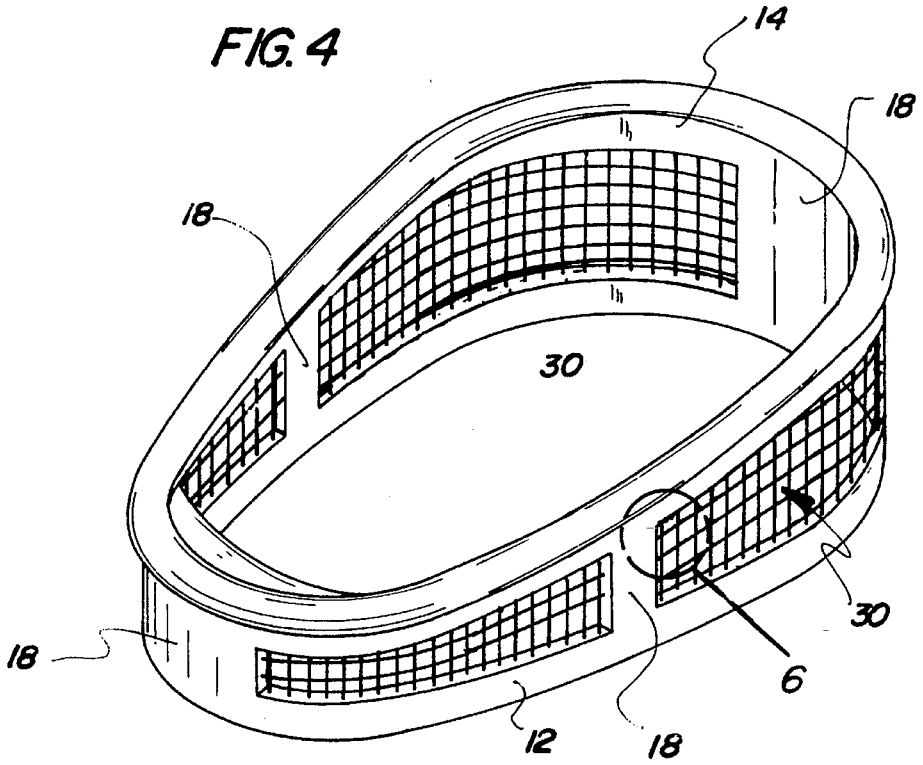
FIG. 4 is an isometric illustration of the invention including mesh pockets.
Figure 6:
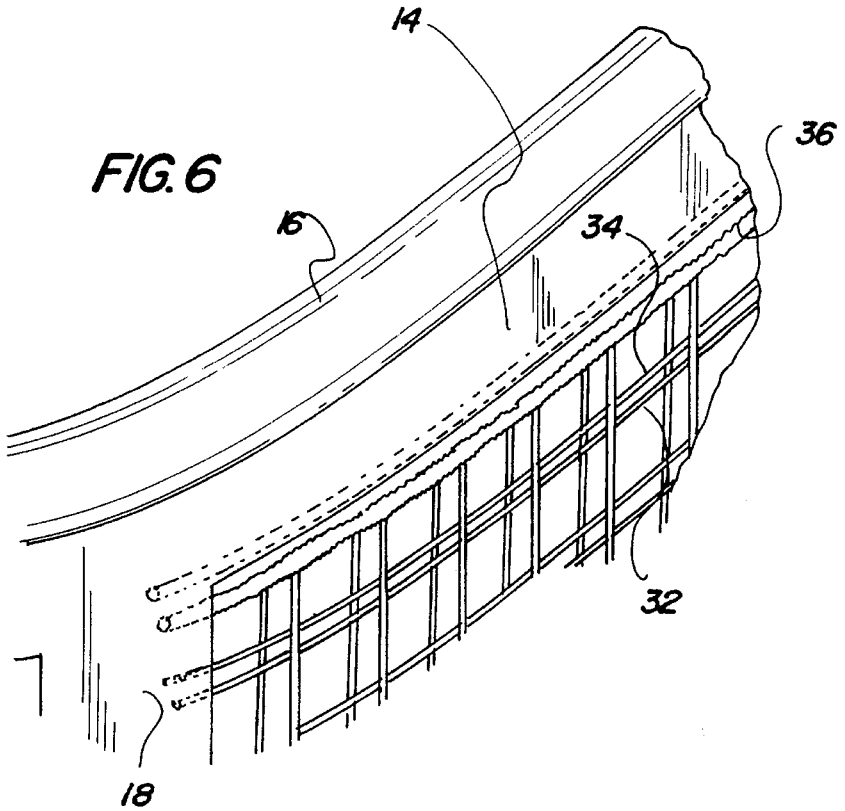
FIG. 6 is an enlarged isometric illustration of the area set forth in FIG. 4.

As shown in FIGS. 4 and 6, the present invention 10 may further comprise a plurality of mesh pockets 30 extending between adjacent stanchions 18 and between the upper end base frames 12 and 14. To this end, and as shown in FIG. 6, each of the mesh pockets 30 comprises an outer mesh web 32 secured to adjacent stanchions 18 and the base frame 12. Similarly, an inner mesh web 34 is secured to adjacent stanchions 18 and the base frame 12. The mesh webs 32 and 34 project upwardly from the base frame 12 and terminate in upper longitudinal edges having an elastic band 36 extending thereacross. The elastic band 36 thus permits selective separation of the mesh webs 32 and 34 so as to permit insertion of objects therebetween for storage relative to the device 10.

Referring now to FIG. 7, it can be shown that the present invention 10 may further comprise a lower mesh pocket 40 extending across the base frame 12. The lower mesh pocket 40 is similarly comprised of inner and outer mesh webs including elastic bands permitting insertion of objects therebetween.

With continuing reference to FIG. 7, it can be shown that the present invention 10 may additionally comprise an interior pad 42 removably coupled within the base frame 12. To this end, the interior pad 42 includes a plurality of hook and loop patches 44 secured to a lower surface thereof which can be cooperatively and releasably engaged to a plurality of hook and loop patches 44 secured to the lower mesh pocket 40. As shown in FIG. 8, the interior pad 42 is preferably constructed of a closed conduit 46 having a thermal gel 48 positioned therein which can be heated or frozen so as to retain thermal energy for application to a human head when positioned within the device 10.

In use, the ground supported head rest 10 of the present invention can be easily utilized for supporting an individual's head relative to a ground surface as shown in FIG. 1 of the drawings. The mesh pockets 30 and 40 of the present invention 10 can be utilized to store various objects relative to the device as desired. The mesh pockets 30 and 40 operate to store objects while simultaneously permitting ventilation into the area between the upper frame 14 and the base frame 12 when an individual is positioned face down within the device 10. The interior pad 42 can be additionally provided to effect thermal heating or cooling of an individual's head when positioned relative to the device 10.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A ground supported head rest comprising:

a base frame positionable upon a ground surface, the base frame residing within a plane;

an upper frame mounted relative to the base frame so as to extend at an oblique angle relative to the plane containing the base frame;

a perimeter pad extending about the upper frame for engaging a human head such that the human head can be supported relative to the ground surface in both prone and supine positions;

wherein the upper frame is supported relative to the base frame by a plurality of stanchions extending therebetween; and wherein the head rest includes a first end spaced from a second end, with the upper frame being spaced a first distance apart from the base frame at the first end thereof, and the upper frame being spaced a second distance apart from the base frame at the second end thereof, wherein the second distance is substantially greater than the first distance so as to define an inclined angular orientation of the upper frame relative to the base frame;

and wherein the upper frame is of a first transverse width at the first end of the head rest and continues to enlarge to a second transverse width proximal to the second end of the head rest, wherein the second width is substantially greater than the first width so as to define a substantially ovoid shade of the upper frame;

the head rest further comprising a chin rest projecting from an interior portion of the upper frame proximal to the first end of the head rest for receiving and supporting a chin of an individual lying in a prone position;

wherein the perimeter pad comprises an elongated cylindrical foam core having a slot directed thereinto which receives a portion of the upper frame; and an outer covering encapsulating the foam core;

the head rest further comprising a plurality of mesh pockets extending between adjacent stanchions and between the upper end base frames, wherein each of the mesh pockets comprises an outer mesh web secured to adjacent stanchions and to the base frame; and an inner mesh web secured to adjacent stanchions and to the base frame, the mesh webs projecting upwardly from the base frame and terminating in upper longitudinal edges having an elastic band extending thereacross, the elastic bands permitting selective separation of the mesh webs to permit insertion of objects therebetween for storage.

2. The ground supported head rest of claim 1, and further comprising a lower mesh pocket extending across the base frame.

3. The ground supported head rest of claim 2, and further comprising an interior pad removably coupled within the base frame.

4. The ground supported head rest of claim 3, and further comprising a plurality of hook and loop patches secured to a lower surface of the interior pad; and a plurality of hook and loop patches secured to the lower mesh pocket which are cooperatively and releasably engaged to hook and loop patches secured to the interior pad.

5. The ground supported head rest of claim 4, wherein the interior pad comprises a closed conduit having a thermal gel positioned therein.

* * * * *